United States Patent [19]

Blevins

[11] 4,303,126

[45] Dec. 1, 1981

[54] ARRANGEMENT OF WELLS FOR PRODUCING SUBSURFACE VISCOUS PETROLEUM

[75] Inventor: Theodore R. Blevins, Los Alamitos, Calif.

[73] Assignee: Chevron Research Company, San Francisco, Calif.

[21] Appl. No.: 125,069

[22] Filed: Feb. 27, 1980

[51] Int. Cl.[3] ..... E21B 43/24; E21B 43/30

[52] U.S. Cl. ..... 166/245; 166/50; 166/272

[58] Field of Search ..... 166/272, 303, 302, 245, 166/50

[56] References Cited

U.S. PATENT DOCUMENTS

| | | | |
|---|---|---|---|
| 2,841,375 | 7/1958 | Salomonsson | 166/256 X |
| 3,017,168 | 1/1962 | Carr | 166/256 X |
| 3,256,935 | 6/1966 | Nabor et al. | 166/245 |
| 3,338,306 | 8/1967 | Cook | 166/50 X |
| 3,960,213 | 6/1976 | Striegler et al. | 166/272 |
| 3,994,340 | 11/1976 | Anderson et al. | 166/272 |
| 4,037,658 | 7/1977 | Anderson | 166/272 |
| 4,089,373 | 5/1978 | Reynolds et al. | 166/256 |

*Primary Examiner*—Stephen J. Novosad

*Attorney, Agent, or Firm*—J. A. Buchanan, Jr.; R. L. Freeland, Jr.; G. W. Wasson

[57] ABSTRACT

A method is disclosed for recovering viscous crudes from petroleum-containing formation, such as tar sand deposits, which are too deep to mine economically but not deep enough, or geologically not structured properly, to successfully hydraulically fracture for well to well production. The method contemplates a field grid layout of sets of injection and production wells and a subsurface generally horizontal heated tubular member passing through the subsurface petroleum-containing formation. Heated fluids are circulated through the tubular members to heat the viscous crudes in the vicinity of the tubular members and a heated drive fluid is injected through the injection wells to move heated crude toward the production wells.

11 Claims, 1 Drawing Figure

ARRANGEMENT OF WELLS FOR PRODUCING SUBSURFACE VISCOUS PETROLEUM

BACKGROUND OF THE INVENTION

This invention relates generally to recovering viscous petroleum from petroleum-containing formations. Throughout the world there are several major deposits of high-viscosity crude petroleum in oil sand not recoverable in their natural state through a well by ordinary production methods. In the United States, the major concentration of such deposits is in Utah, where approximately 26 billion barrels of in-place heavy oil or tar are believed to exist. In California, the estimate of in-place heavy oil or viscous crude is 220 million barrels. One of the large deposits in the world in the Province of Alberta, Canada, representing a total estimated in-place resource of almost 1000 billion barrels. The depths of these deposits range from surface outcroppings to about 2000 feet.

To date, none of these deposits has been produced comercially by an in situ technology. Commercial mining operations in a shallow Athabasca deposit and other mining projects are proposed at the present time. There have been many in situ well-to-well pilots, all of which used some form of thermal recovery after establishing communication between injector and producer. Normally such communication has been established by introducing a pancake fracture. The displacing or drive mechanism has been steam and combustion, such as the project at Gregoire Lake, or steam and chemicals, such as the early work on Lease 13 of the Athabasca deposit. Another means of developing communication is that proposed for the Peace River project where well-to-well communication is expected to be developed by injecting steam over a period of several years into an aquifer underlying the tar sand deposit at a depth of around 1800 feet. Probably the most active in situ pilot in the oil sands has been that at Cold Lake. This project uses the huff-and-puff single-well method of steam stimulation and has been producing about 5000 barrels of viscous petroleum per day for several years from about 50 wells. This is probably a semi-commercial process, but whether it is an economical venture is still unknown.

The most difficult problem for any in situ well-to-well viscous petroleum project is establishing and maintaining communication between injector and producer wells. In shallow deposits, fracturing to the surface has occured in a number of pilots so that satisfactory drive pressure within the producing formation could not be maintained. In many cases, problems arise from healing of the fracture when the viscous petroleum that had been mobilized through the application of heat then cooled as it moved toward the producer well. The cool petroleum is essentially immobile, since its viscosity in the Athabasca deposits, for example, is on the order of 100,000 to 1 million cp at reservoir temperature.

As noted, the major problem of the economic recovery from many formations has been establishing and maintaining communication between an injection position and a recovery position in the viscous oil-containing formation. This is primarily due to the character of the formations, where fluid mobility or formation permeability may be extremely low, and in some cases, such as the Athabasca Tar Sands, vitually nil. Thus, the Athabasca Tar Sands, for example, are strip mined where the overburden is limited. In some tar sands, hydraulically fracturing has been used to establish communication between injectors and producers. This has not met with uniform success. A particularly difficult situation develops in the intermediate overburden depths, which are too deep to mine economically but not deep enough to successfully hydraulically fracture from well to well.

Heretofore, many processes have been utilized in attempting to recover viscous petroleum from viscous oil formations of the Athabasca Tar Sands type. The application of heat to such viscous petroleum formations by steam or underground combustion has been attempted. The use of slotted liners positioned in the viscous oil formation as a conduit for hot fluids has also been suggested. However, these methods have not been particularly successful because of the difficulty of establishing and maintaining communication between the injector and the producer.

In issued patents assigned to the same assignee as this application, i.e. U.S. Pat. No. 3,994,340 issued Nov. 30, 1976 to D. J. Anderson et al for "Method of Recovering Viscous Petroleum From Tar Sands" and U.S. Pat. No. 4,037,658 issued July 26, 1977 to D. J. Anderson for "Method of Recovering Petroleum From An Underground Formation", techniques have been described for recovery of viscous petroleum, such as from tar sands, by using a substantially vertical passage from the earth's surface which penetrates the tar sand and a laterally extending hole containing a flow path isolated from the tar sand for circulating a hot fluid to and from the vertical passage to develop a potential flow path within the tar sand into which a drive fluid is injected to promote movement of the petroleum to a production position.

BRIEF DESCRIPTION OF THE INVENTION

The present invention is directed to a field installation wherein use is made of the method of assisting the recovery of viscous petroleum from a petroleum-containing formation. The method described herein is particularly useful in those formations where communication between an injector and a producer is difficult to establish and maintain. A plurality of holes are formed through the petroleum-containing formation and a solid-wall, hollow tubular member is inserted into each hole to provide a continuous, uninterrupted flow path laterally through the formation. A hot fluid is flowed through the interior of the tubular members out of direct contact with the formation to heat viscous petroleum in the formation outside the tubular members to reduce the viscosity of at least a portion of the petroleum adjacent the outside of the tubular member to provide a potential passage for fluid flow through the formation adjacent the outside of the tubular member. A drive fluid is then injected through vertical wells completed near the lateral tubular member and into the formation along the passage adjacent to the tubular member to promote movement of the petroleum for recovery from the formation. In a preferred form the hot fluid which is flowed through the tubular member is steam, and the drive fluid used to promote movement of the petroleum is also steam. Depending on certain conditions, the hot fluid and the drive fluid are injected simultaneously. Under other conditions, the hot fluid and the drive fluid are injected intermittently. The injectivity of the drive fluid into the formation is controlled to some extent by adjusting the flow of hot fluid through the tubular member. In this manner, the sweep efficiency of the drive fluid in the formation may be improved.

In the application of the method to a field installation it is desirable to produce a grid pattern of substantially equally spaced producing wells near to or above the lateral hollow tubular members. The injected hot fluid forced through the passage adjacent to the heated hollow tubular members is injected through the formation either perpendicular or parallel to the permeability trend of the formation containing the viscous petroleum.

OBJECT OF THE INVENTION

The principal object of the present invention is to maximize recovery of viscous petroleum from a petroleum containing formation by establishing a pattern of producing wells near or above a plurality of lateral formation heating tubes with a pattern of drive fluid injection wells positioned in a preferred relationship with the permeability trend of the viscous petroleum-containing formation. Further objects and features of the present invention will be readily apparent to those skilled in the art from the appended drawing and specification illustrating a preferred embodiment wherein:

FIG. 1 is a perspective view partially in section illustrating the preferred arrangement of producing wells, lateral heating tubes and injection wells in a subsurface viscous petroleum containing formation.

DETAILED DESCRIPTION OF THE INVENTION

Figure 1:
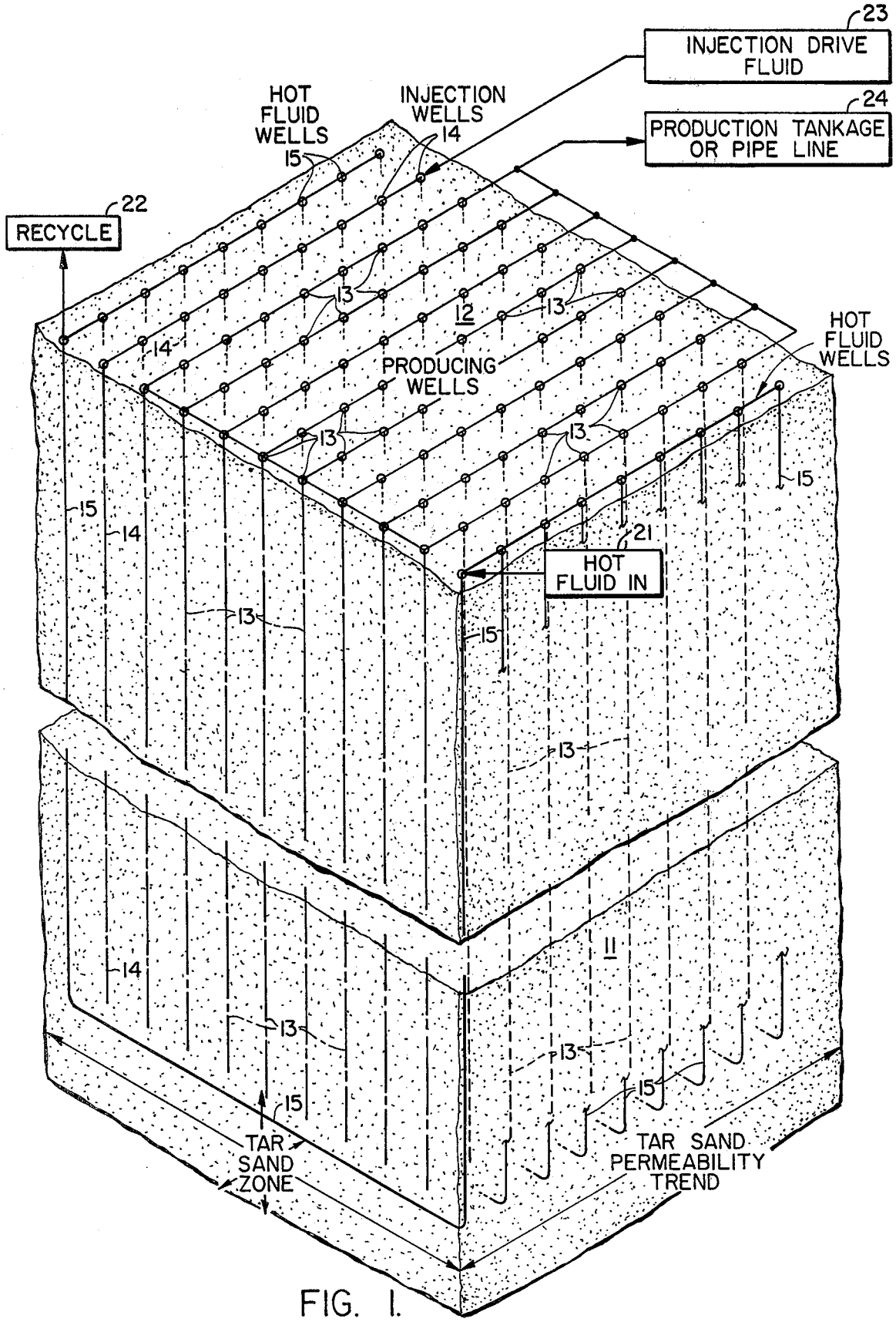

The present invention constitutes a field pattern of producing, injecting and formation heating wells for the production of viscous petroleum from a subsurface formation such as a tar sand. FIG. 1 illustrates such a formation, designated 11, shown in a perspective cross-section through an earth formation. At the surface 12 of the earth formation a pattern of wells is established with wells 13 representing producing wells, wells 14 representing injection wells and wells 15 representing continuous vertical and lateral formation heating wells or tubes through the formation. As illustrated in FIG. 1 the grid of wells includes nine walls in a row and nine rows of producing/injection wells. A row of wells at each side of the grid represents the entrance and the exit of the continuous vertical/lateral formation heating wells.

In accordance with the present invention the formation heating wells 15 are preferably aligned laterally across the subsurface viscous petroleum containing formation perpendicular to the permeability trend of the formation.

One alignment of the injection wells 14 selects the wells at one side of the grid pattern with the downhole end of each well aligned in proximity to the lateral portion of a formation heating well 15. In other alignments, the injection wells may be in any of many sets within the grid pattern but always with the downhole end in proximity to a lateral portion of a heating well 15.

The producing wells 13 are preferably equally spaced in rows above the formation with the downhole end of the producing wells in close proximity to the lateral portion of each formation heating well 15.

A preferred spacing for the grid of wells at the surface of the formation is between 100 and 300 feet between centers, with an expected maximum efficiency for production of the viscous crude from a well spacing of 200 feet. At the subsurface location it is preferred that the downhole end of the wells be between 35 and 10 feet from the lateral portion of the formation heating wells.

As illustrated in block diagram form in FIG. 1 and as described in the previously identified issued patents, the formation heating wells 15 provide a continuous, solid wall hollow tubular conduit for passing hot fluids, such as steam, from source 21 through the subsurface formation to accomplish heating of the viscous petroleum to reduce the viscosity of at least a portion of the petroleum adjacent to the outside of the tubular conduit to provide a potential passageway for fluid flow through the subsurface formation adjacent to the outside of the tubular member. The hot fluid is circulated continuously through the wells 15 and collected at the outlet wells to a recycle facility 22 for reprocessing and reinjection.

A drive fluid is injected from a source 23 through injection wells 14 to a downhole location adjacent to the lateral portions of formation heating wells 15 in communication with the passageway created adjacent to the outside of the tubular member. The drive fluid promotes the flow of petroleum toward the recovery or producing wells 13. Steam is the preferred drive fluid; however, other fluids such as gas, water or surfactant fluids may be useful as drive fluids.

The producing wells 13 are connected at the surface with tankage or a pipeline at 24 and aligned with their downhole ends adjacent to the lateral portions of the formation heating wells 15 in communication with the passageways established adjacent to the tubular members. With proper control of the temperature and rate of flow of drive fluid and formation heating fluid, the heated viscous petroleum may be produced up through the production wells to the surface facilities at 24. Suitable pumping means or other controls may be provided to lift the produced petroleum up through the producing wells.

It should be understood that the wells shown are only schematic illustrations of the field installation and that each well will be suitably cased to insure the placement of the heating and driving fluids in the proper subsurface location. The producing wells will be provided with selected screens, perforations or slotted liners to prevent excessive sand production while maximizing petroleum production. The solid lines connecting the injection, production and formation heating wells, respectively, at the earth's surface 12 are intended to illustrate a manifold system. Suitable valving would be included to control separate wells and to select combinations and sets of injection and production wells.

The method of the present invention would find application in shallow heavy oil formations that are too deep for mining and too shallow for conventional steam or other hot fluid recovery methods. Generally, the formations of interest would be petroleum sands with an overburden of 300 to 600 feet.

Laboratory demonstrations show that the method of the present invention satisfactorily stimulated a core of the Athabasca Tar Sand deposit having zero effective mobility. The recovery demonstrations showed that a communication path between injector and producer can be successfully developed; and provided excessive heating of the in-place tubular member is avoided, recoveries up to 65% of the petroleum in place can be achieved. The sweep efficiency is surprisingly high, resulting in an even distribution of residual oil. This means that the reservoir, after being subjected to an assisted-recovery operation conducted in accordance with the present invention, would still be amendable to further recovery techniques such as in situ combustion or chemical floods. Particularly attractive is the fact that injected drive fluids would be expected to be confined to the area of interest between injector and producer, since that area would be the only pathway open by the heated tubular member. In other words, it is unlikely that the fluids would be lost to the other parts of the reservoir because of the relative impermeability of the formation on the outer edge of the swept area.

A preferred drilling program for placing the wells and conduits within a subsurface petroleum-containing formation would be to drill the hot fluid wells first and positioning the generally horizontal connecting subsurface tubular members in communication with the hot fluid inlet and outlet wells. After the tubular members were placed, then the pattern of generally vertical injection and producing wells would be drilled. The method is not, however, limited to the order in which the wells are drilled.

While a certain preferred embodiment of the invention has been specifically illustrated and described, the invention is not limited to any of the specific embodiments but is meant to include all modifications coming within the terms of the following claims.

What is claimed is:

1. A field method of recovering viscous petroleum from a subsurface petroleum-containing formation comprising:

(a) establishing a grid pattern of locations at the earth's surface above said formation and drilling a set of first wells into said subsurface formation from substantially equally spaced locations in accordance with said grid pattern;

(b) drilling a plurality of second wells at least a portion of each of said wells passing substantially horizontally through said subsurface formation in the vicinity of and substantially perpendicular to said first wells;

(c) circulating a hot fluid through said second wells to reduce the viscosity of said viscous petroleum in said formation adjacent to the outside of said second wells to form a potential passageway within said formation adjacent to said second wells for flow of petroleum in said passageway outside of said second wells;

(d) and injecting a drive fluid into said formation through said passageway to promote flow of petroleum in said formation to said first wells for recovery from said formation.

2. The method of claim 1 wherein said grid pattern is a pattern of equally spaced wells spaced not less than 100 feet and not more than 300 feet in both horizontal directions.

3. The method of claim 1 wherein said grid pattern is a pattern of equally spaced wells spaced about 200 feet in both horizontal directions.

4. The method of claim 1 wherein said grid pattern is established with said first wells aligned with the permeability trend of said subsurface formation.

5. The method of claim 1 wherein said second wells are drilled through said formation in alignment with the permeability trend of said subsurface formation.

6. The method of claim 1 wherein said injected drive fluid is injected through an aligned set of said first wells in said grid pattern, said set being perpendicular to said second wells and to the permeability trend of said subsurface formation, and said drive fluid being injected to move along said formation in alignment with the permeability trend thereof.

7. The method of claim 6 wherein said aligned set of said first wells is at an edge of said grid pattern.

8. The method of claim 1 wherein said second wells are laterally spaced from aligned sets of said first wells and within said grid.

9. The method of claim 1 wherein said second wells are above the bottom of said first wells.

10. The method of claim 1 wherein said second wells are below the bottom of said first wells.

11. The method of claim 1 wherein said second wells are about 10 feet from a row of said first wells within said grid.

* * * * *